United States Patent [19]

Wells et al.

[11] 4,146,777

[45] Mar. 27, 1979

[54] HEAT CONSERVER FOR BELL-TYPE OVENS

[75] Inventors: Harold D. Wells; Edwin W. Hughes, III, both of St. Louis County, Mo.

[73] Assignee: Black Body Corporation, Fenton, Mo.

[21] Appl. No.: 803,659

[22] Filed: Jun. 6, 1977

Related U.S. Application Data

[63] Continuation of Ser. No. 630,808, Nov. 11, 1975, abandoned, which is a continuation of Ser. No. 434,816, Jan. 21, 1974, abandoned.

[51] Int. Cl.[2] ..... F27D 11/03

[52] U.S. Cl. ..... 219/411; 53/557; 219/349; 219/385; 219/388

[56] References Cited

U.S. PATENT DOCUMENTS

| | | | |
|---|---|---|---|
| 1,802,407 | 4/1931 | Danninger et al. | 219/388 W |
| 2,852,651 | 9/1958 | Crumrine et al. | 219/388 W |
| 3,053,962 | 9/1962 | Cerasani | 219/388 W |
| 3,275,799 | 9/1966 | Meltzer | 219/354 |
| 3,493,724 | 2/1970 | Wells | 219/345 |
| 3,531,873 | 10/1970 | Beck | 53/184 S |
| 3,717,939 | 2/1973 | Mitchell | 34/230 |
| 3,723,708 | 3/1973 | Tulkoff | 219/349 |
| 3,809,859 | 5/1974 | Wells | 219/342 |
| 3,897,671 | 8/1975 | Higgins | 53/305 |

FOREIGN PATENT DOCUMENTS

| | | | |
|---|---|---|---|
| 2082861 | 10/1971 | France | 53/184 S |

*Primary Examiner*—J. V. Truhe
*Assistant Examiner*—Bernard Roskoski
*Attorney, Agent, or Firm*—Ralph W. Kalish

[57] ABSTRACT

A heat conserver for bell-type ovens, which latter comprehends a housing which is closed at its sides and top and open at its bottom with heating elements as of the infrared emitter-type located adjacent the lower end. One form of the conserver consists of a frame having heat reflective surfaces for confronting relationship to the heating elements when the oven is in raised or inoperative position for directing the radiated heat returningly thereon. Another form of the conserver is a flat plate for disposition closingly across the normally open lower end of the housing when the latter is in inoperative position. Both forms of the invention are adapted for vertical reciprocal movement.

14 Claims, 11 Drawing Figures

HEAT CONSERVER FOR BELL-TYPE OVENS

This is a continuation of application Ser. No. 630,808 filed Nov. 11, 1975, now abandoned; which is a continuation of application Ser. No. 434,816 filed Jan. 21, 1974 abandoned.

BACKGROUND AND SUMMARY OF THE INVENTION

This invention relates in general to materials handling, and, more particularly, to a heat conserver for bell-type ovens primarily designed for heat shrinking of a protective plastic film about a pallet-supported load.

It is a primary object of the present invention to provide a heat conserver for use with bell-type ovens for preventing heat loss while the oven is in inoperative position. It is customary to maintain the heating elements of such ovens in a constantly energized state so that during the intervals between actual heat shrinkage, there is sustained a most substantial loss of radiated heat.

It is another object of the present invention to provide a heat conserver for bell-type ovens which uniquely serves to effect a substantially even heat distribution throughout the oven during the inoperative periods so that when the oven is presented to the work, the resultant shrinkage will be substantially uniform as contradistinguished from ovens currently used wherein a relatively higher temperature is developed in the upper portion of the oven during inoperative junctures resulting in an undesired increase in shrinkage in the upper portion of the work.

It is a further object of the present invention to provide a heat conserver of the type stated which conduces to marked economy in operation of bell-type ovens.

It is another object of the present invention to provide a heat conserver of the character stated which may be easily adapted for utilization in conjunction with currently operated ovens, without necessitating costly and time-consuming modifications.

It is a further object of the present invention to provide a heat conserver of the type stated which is of sturdy construction, being fabricated of markedly few components of simple character thereby conducing to durability and reliability.

It is a still further object of the present invention to provide a heat conserver of the type stated which is especially suitable for use with ovens having infrared emitters which have high heat emissivity, as well as excellent heat absorption for re-emission.

It is another object of the present invention to provide a heat conserver economical in construction and the incorporation of which materially enhances the usability of bell-type ovens.

DESCRIPTION OF PRACTICAL EMBODIMENTS

Figure 6:
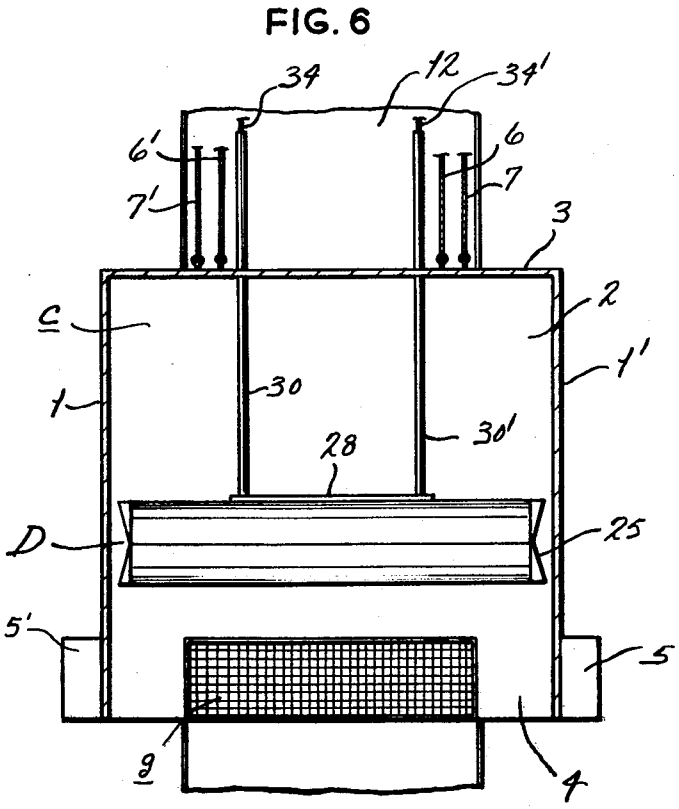
FIG. 6 is a vertical transverse sectional view taken on the line 6—6 of FIG. 4.
Figure 1:
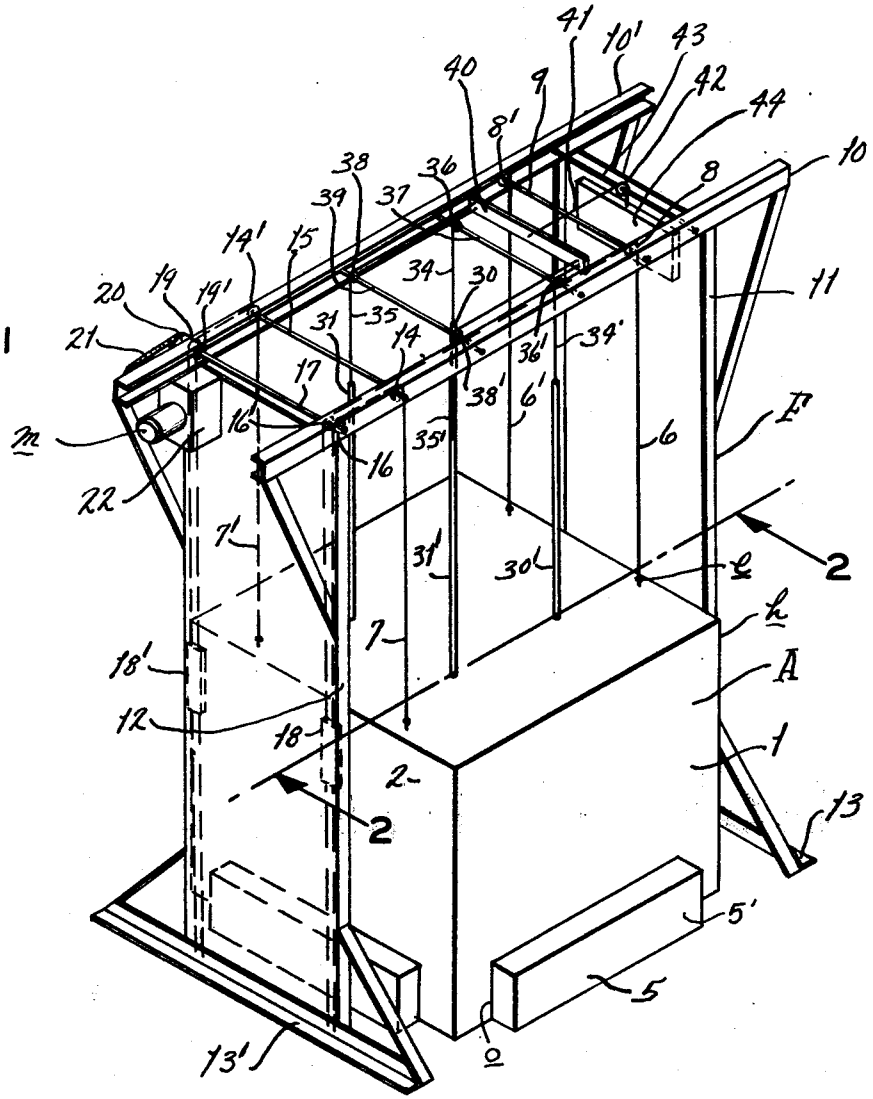
FIG. 1 is a perspective view of a bell-type oven in operative position and containing a heat conserver constructed in accordance with and embodying the present invention.

Referring now by reference characters to the drawings which illustrate practical embodiments of the present invention, A generally indicates a conventional oven of the bell-type having a housing h suitably suspended by means presently to be described for vertical, reciprocal movement between upper, inoperative position (FIG. 5) and downward, operative position (FIG. 1) wherein the same encloses a discrete load, such as containers and the like, being preferably pallet-supported, and covered by a heat shrinkable plastic film. Heating elements within housing h cause the film to shrink so as to cover the load snugly for retaining same against inadvertent displacement as well as for protection against atmospheric conditions.

Thus, housing h is of bell character, being box-like, having parallel front and back walls 1,1' and parallel side walls 2,2'; there being a top wall 3, defining a chamber c open at its bottom as at 4. Said housing h may be of any predetermined dimensions, being square or rectangular, but the same is designed for incasing a storage or loading pallet p of preselected area having a load 1 stacked thereon to a compatible height. Carried upon housing h adjacent its lower open end, and desirably upon each side wall thereof, is a heating element 5 which may be of any suitable type, such as, by way of example only, infrared emitters of panel character which may be of the type shown in U.S. Pat. Nos. 3,493,724 and 3,809,859. Heating elements 5, with their peculiar distribution, provide heat evenly about a plastic sheet s disposed coveringly of said load 1 and pallet p for uniform shrinkage thereabout, whereby said sheet s will be drawn tightly.

Housing h is suspended for vertical reciprocal movement within a support frame or gantry F by various means, such as by two pairs of chains 6,6' and 7,7'; the lower ends of which are secured to housing top wall 3 as by eyelets e. Said chains 6,6', which are proximate side wall 2', are trained upwardly from their lower ends about sprockets 8,8', respectively, mounted upon the opposite ends of a shaft 9 extending transversely between, and journalled at its ends, in the webs of a pair of spaced apart, parallel, channel beams 10,10, respectively. Beams 10,10' are secured, spacedly apart, upon the upper edges of parallel end panels 11,12, which latter are respectively outwardly of housing side walls 2,2', with their lower ends being secured to base structures 13,13', respectively. Said panels 11,12 of frame F extend substantially above housing h when the latter is in lowered, operative position, presenting beams 10,10' a distance above the support surface adequate to assure that housing h may be moved upwardly for clearing a pallet load after the shrinking operation has been completed to permit facile withdrawal of such load and disposition of another load for treatment.

Chains 7,7' upwardly of housing h are engaged about sprockets 14,14', respectively, which are carried upon the end portions of a driven shaft 15 axially parallel to shaft 9 and being journalled at its ends in said beams 10,10', respectively. Chains 6,7 are directed along parallel paths from their respective sprockets 8,14, for disposition about sprockets 16,16', respectively, mounted in side-by-side relationship on one end of a driven shaft 17 also journalled at its end portions in beams 10,10', laterally outwardly of, and axially parallel to, shaft 15. Said shaft 17 is located immediately above the upper end of panel 12 with chains 6,7 progressing downwardly from said sprockets 16,16', respectively, for securement at their outer or lower ends to a counterweight 18. Chains 6',7', similarly continue in parallel paths along beam 10', from their respective sprockets 8',14' for engagement about sprockets 19,19', respectively, carried upon said shaft 17 in opposed relationship to sprocket 16,16'; said chains 6',7' extending downwardly from sprockets 19,19' adjacent upright 12' for securement to a counterweight 18'.

Shaft 17 projects outwardly beyond beam 10' and carries a sprocket 20 upon such extended portion, about which is engaged one end portion of a drive chain 21, the other end portion of which extends about a sprocket (not shown) fixed on the end of an output shaft (not shown) of a speed reducer 22 operatively connected in the usual fashion to a prime mover m. Said speed reducer 22 and prime mover m are mounted upon frame F, as upon as extension of beam 10'; there being variable control means (not shown) for effecting energization and de-energization of prime mover m.

Figure 2:
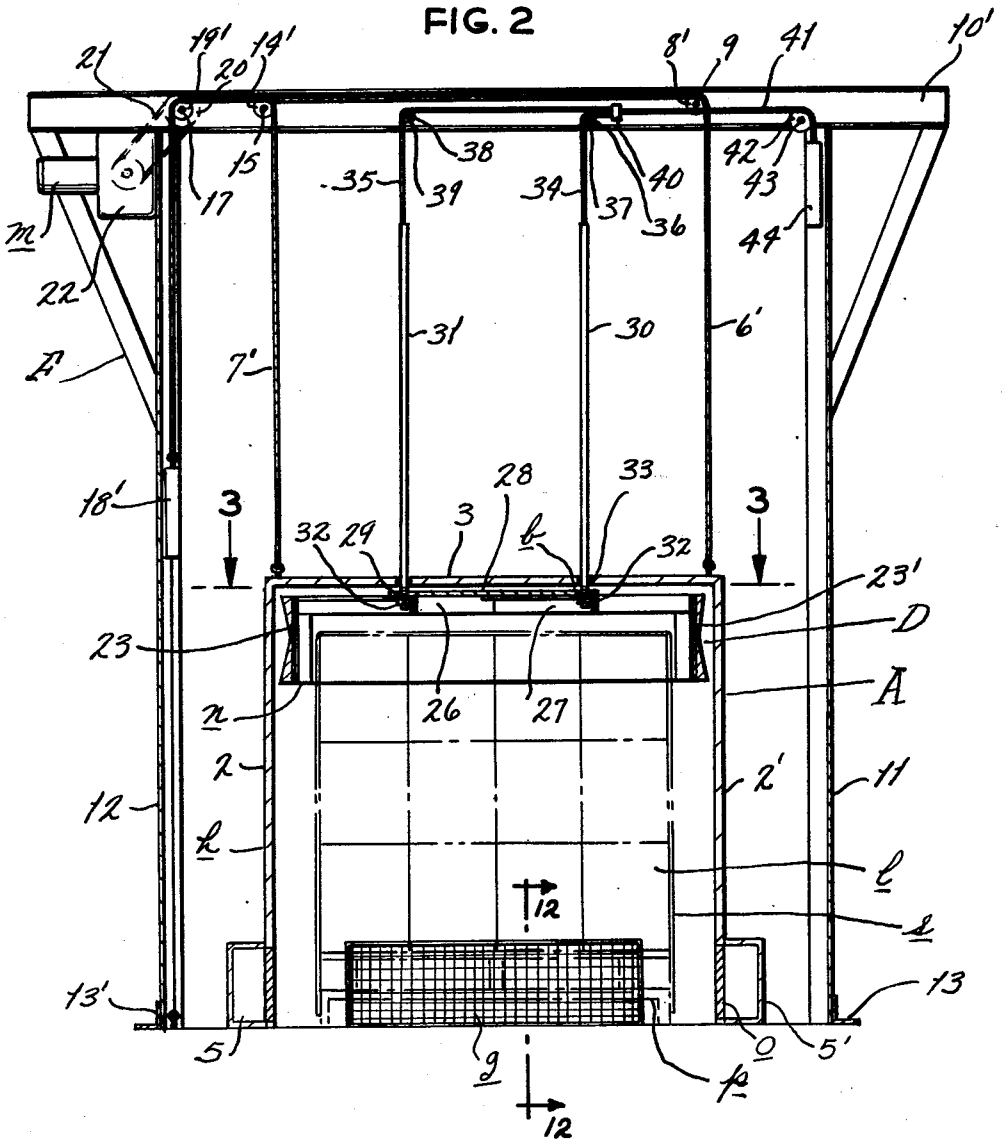
FIG. 2 is a vertical transverse sectional view taken on the line 2—2 of FIG. 1.

Referring now to FIG. 2, D designates a heat conserver for use with housing h of oven A and comprises an open, four-sided frame n having parallel side components 23,23' and parallel end components 24,24', with the same being mutually secured at their ends, as by brackets, welding, or the like, for forming a sturdy unit. The extent of said side and end components of said frame n are commensurate with the length of the corresponding, confronting walls of housing h; with said frame n having a cross-sectional area slightly less than housing h for unimpeded relative vertical movement therein; said components 23,23', 24,24' being thus greater in length than the heating elements 5 of the adjacent housing wall portions and with a height substantially equal to that of said heating elements 5. Secured upon the outwardly directed face of each side and end component of frame n of conserver D, and coextensive therewith, is a heat reflective surface-forming member 25 which may be, in contour, concave, re-entrant, flat, or the like; but being illustrated in the drawings as of re-entrant character with the central zone thus being located slightly inwardly of the upper and lower end zones. Member 25 may be formed of stainless steel, aluminum, or any other suitable material effective for providing heat reflectivity.

Figure 3:
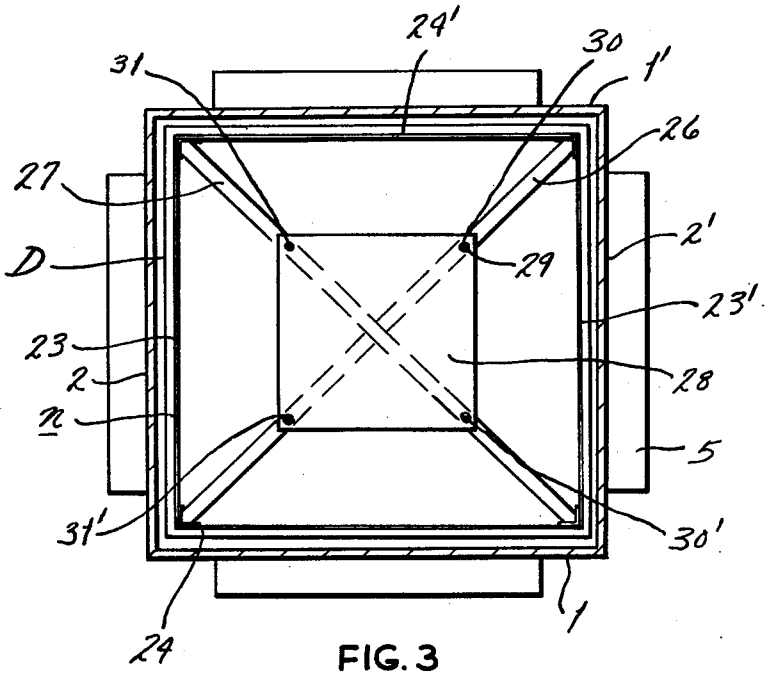
FIG. 3 is a horizontal transverse sectional view taken on the line 3—3 of FIG. 2.

As best seen in FIG. 3, said frame n of conserver D also includes a pair of braces 26,27 which may be of angle stock, fixed at their ends, as by brackets, in the upper portions of diagonally opposed corners of said frame n so as to intersect centrally of the upper open end of said frame n. Fixed, as by welding, upon the upper surfaces of braces 26,27, in the region comprehending the point of intersection, is a flat rigidifying mounting plate 28 having an opening, as at 29, in each of its corner portions for alignment with an aperture b in the underlying portion of the adjacent brace 26,27 for extension therethrough of the lower threaded ends of axially parallel support rods which are four in number and in spaced, paired relationship, front to back of housing h and with said rods being indicated at 30,30' and 31,31'. The lower projecting end of each of said rods 30,30',31,31' is engaged beneath the particular brace 26,27 by a nut 32. Each of said rods 30,30',31,31 extends freely through a relatively enlarged registering opening, as indicated at 33, formed in housing top wall 3. At their upper ends rods 30,30' are engaged to the lower ends of chains 34,34', respectively, and said rods 31,3' are similarly connected to the lower ends of chains 35,35', respectively. Chains 34,34' extend upwardly for disposition about sprockets 36,36', respectively, carried upon a shaft 37 journalled at its ends in beams 10,10' and extending therebetween; while chains 35,35' correspondingly continue upwardly for disposition about sprockets 38,38', respectively, mounted on the end portions of a shaft 39 journalled at its ends in beams 10,10' in axially parallel relationship to shaft 37. Said chains 34,35 progress from their respective sprockets 36,38, respectively, in parallel paths in a direction generally toward side wall 2' of housing h for engagement to a chain bar 40 which latter is also secured to chains 34',35' which in like fashion progress from their respective sprockets 38',38', respectively, in parallel paths adjacent beam 10' toward said bar 40. Chain bar 40 in its central zone is fixed to the inner end of a chain 41 which is engaged about a sprocket 42 mounted centrally upon a shaft 43 journalled in beams 10,10' proximate the upper end of panel 12; with the other or outer end of chain 41 being suitably secured to a counterweight 44. Counterweight 44 is weighted with relation to the heat conserver D so as to urge or bias same upwardly with respect to main frame F.

Counterweight 44 is thus designed to balance heat conserver D so that the same is in registration with heating elements 5 of housing h when said housing h is in full upward or inoperative position.

With a plastic-sheet cover presented to oven A for shrinkage as above outlined, prime mover m is energized to cause weights 18,18' to be raised with consequent lowering of housing h for enclosing disposition about such load 1 and pallet p (FIG. 2). In its downward travel housing h will, by means of the undersurface of its top wall 3, contact frame n of heat conserver D as the same reposes in its state of balance and thereby causes the effect of counterweight 44 to be overcome with frame n then moving with the descending housing h. When housing h has reached its lower, fully operative position and, thus, the force acting upon frame n of conserver D is arrested, said frame n will thus be presented in the upper portion of housing h as may best be seen in FIG. 2. Due to its internal dimensions, frame n is sufficiently removed from load 1 so as to present no interference with the same.

Figure 5:
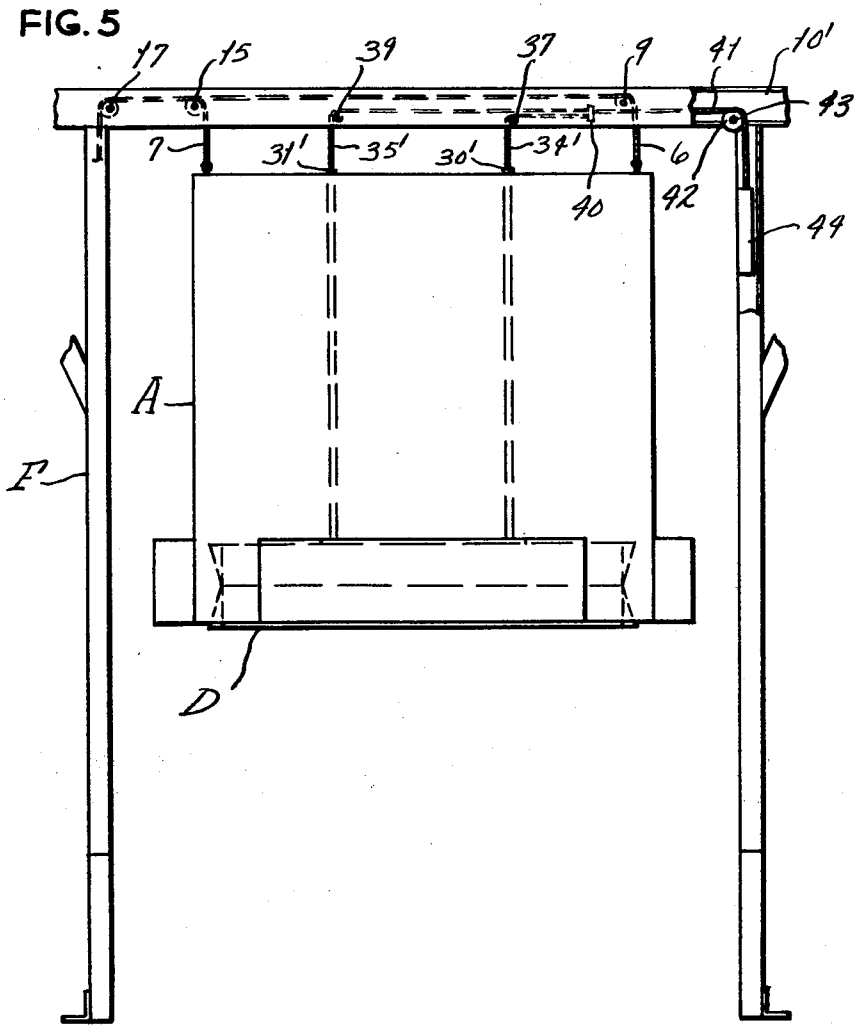
FIG. 5 is a side elevational view showing the oven housing in fully raised, inoperative condition.
Figure 4:
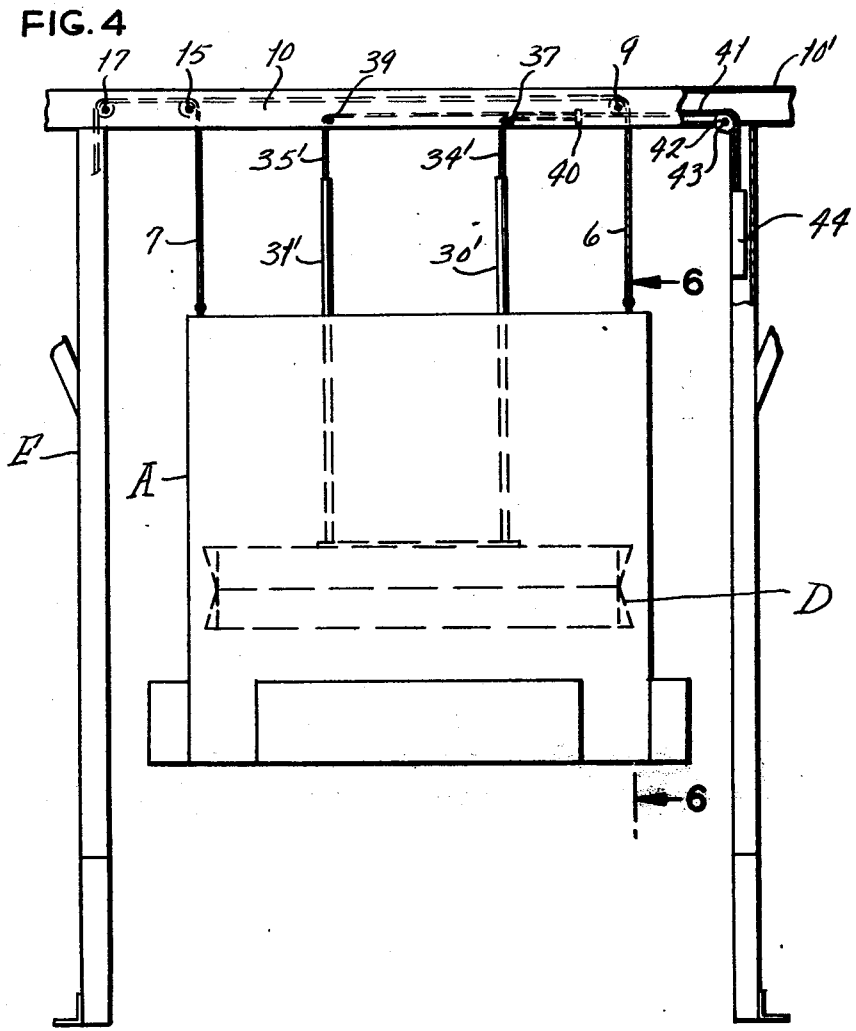
FIG. 4 is a side elevational view showing the oven housing in partially raised condition.
Figure 10:
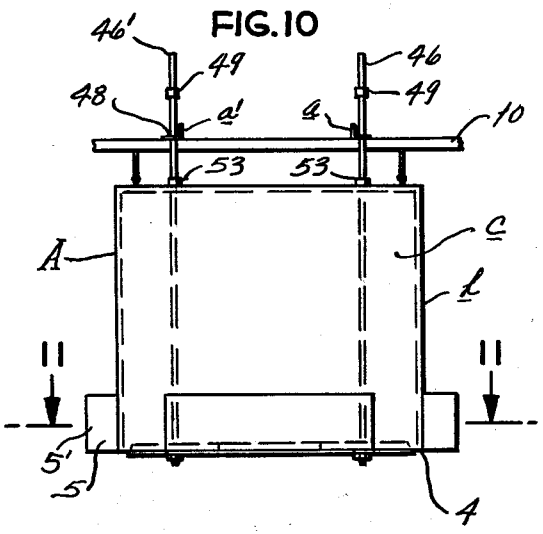
FIG. 10 is a side elevational view illustrating the oven housing shown in FIG. 7 in fully raised, inoperative condition.
Figure 9:
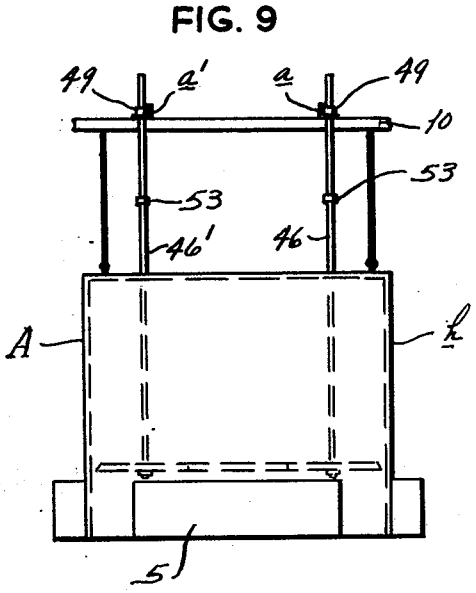
FIG. 9 is a side elevational view of the oven housing shown in FIG. 7 but illustrating same in partially raised condition.
Figure 11:
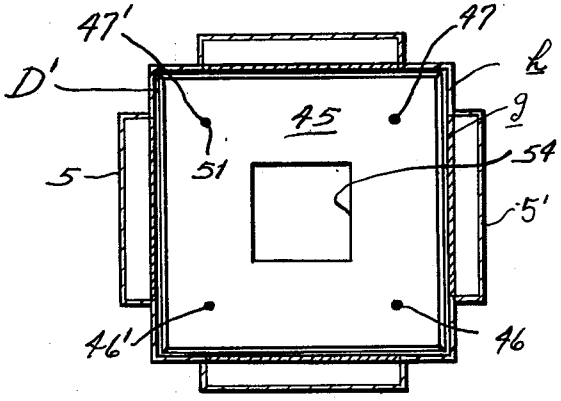
FIG. 11 is a horizontal transverse sectional view taken on the line 11—11 of FIG. 10.

Upon completion of the shrinking operation, housing h, through operation of prime mover m, is shifted upwardly, with housing top wall 3 being removed from frame n to permit influence thereon by counterweight 44 for upward travel whereby said frame n is restored to balanced condition with member 25 is alignment with heating elements 5 of the now elevated housing h (FIG. 5).

As it is uneconomical to cause elements 5 to be fully energized at all times, it is manifestly preferable that such elements be maintained at the particular selected working temperature. By means of the present invention less energy is required to maintain said elements at such temperature; in other words, the same stays relatively hotter with relatively less input energy.

With conserver D in confronting relationship to heating elements 5 the heat emitted from the latter is received upon members 25 and reflected returningly to said heating elements 5 which, as in the case of infrared emitters, have a substantial heat absorptive capacity, as well as a high heat emissivity. Thus member 25 substantially inhibits heat radiation upwardly into the upward portion of housing h and heat loss downwardly through the open lower end 4 of said housing h. By operation of heat conserver D, housing h when in inoperative position, is maintained in, what might be considered, a relatively cool condition, that is, below the selected shrink temperature. By virture of this state, there will be obviated the heretofore accepted, undesired over-heating of the upper portion of housing h so that when the latter is lowered into operative position a premature heating of the upper portion of the plastic cover will occur, thereby causing an uneven shrinkage of said cover about the load 1.

Heretofore, bell-type ovens during the inoperative interval have consistently become too hot through radiation from the constantly energized heating elements; and by convection, the upper portion of the housing h thus becomes more heated than the lower portions. Accordingly, as the housing h is lowered, the shrinkage occurs at the top rather than the bottom of the load. With the present invention, the heating of the plastic sheet at the bottom is assued so that proper tying to the pallet p will develop for an effective underlock conducing to load stability and then as the housing h is raised, the upper portions of the sheet will become progressively shrunk in accordane with desired practice.

Heat conserver D also causes heating elements 5 to be maintained at their appropriate operating temperature by reason of inhibiting heat loss so that extra power is not required for compensating for such loss which has been the accepted condition in all current ovens.

Referring now to FIGS. 7–11, inclusive, another form of heat conserver is indicated at D′, illustrated for use with oven A, it being understood that oven A is of the same construction and character as that hereinabove described so that like numerals indicate like elements.

Conserver D′ comprises a flat plate 45 having a contour corresponding to the transverse contour of housing h and having a cross-sectional area slightly less than that of housing h to provide sufficient edge clearance permitting of relative movement therein. Plate 45 is suspended from a pair of support angles a,a′ which are fixed, as by welding, upon beams 10,10′ of frame F, in axial normal relationship thereto and projecting at their ends therebeyond (See FIG. 8), by means of four rods 46,46′,47,47′. At their upper ends, each of said rods 46,46′,47,47′ projects freely through openings 48 provided in the proximate end portions of support angles a,a′. Carried upon the upper end of each of said rods 46,46′,47,47′ is a detent collar 49 for abutment upon the upper surface of the related support angle a,a′ for limiting the downward movement of plate 45 with respect to frame F. At their lower ends, each of said rods 46,46′,47,47′ extend through aligned apertures 50,51 in housing top wall 3 and plate 45 respectively; the lower extremities of said rods being threaded for engagement to retaining nuts 52. Each aperture 50 is relatively enlarged to conduce to facile slidability of the associated rod therethrough. Carried upon each rod 46,46′, 47,47′ downwardly of the proximate support angle a,a′ is an abutment collar 53 for purposes presently appearing.

Figure 7:
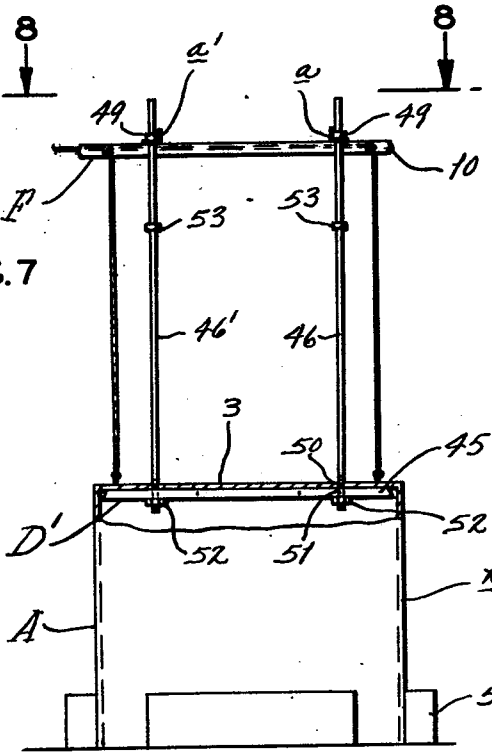
FIG. 7 is a side elevational view, in partial section, of a bell-type oven in operative position and having another form of heat conserver constructed in accordance with and embodying the present invention.
Figure 8:
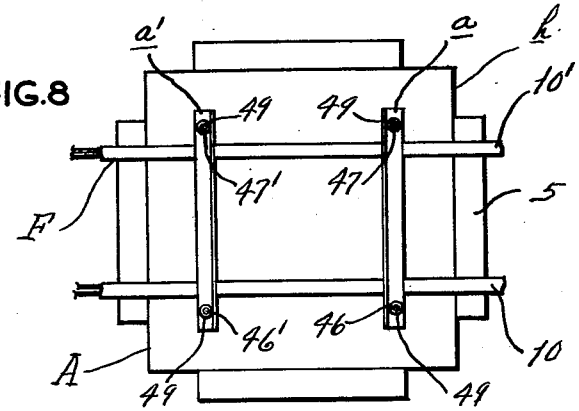
FIG. 8 is a top plan view taken on the line 8—8 of FIG. 7.
Figure 12:
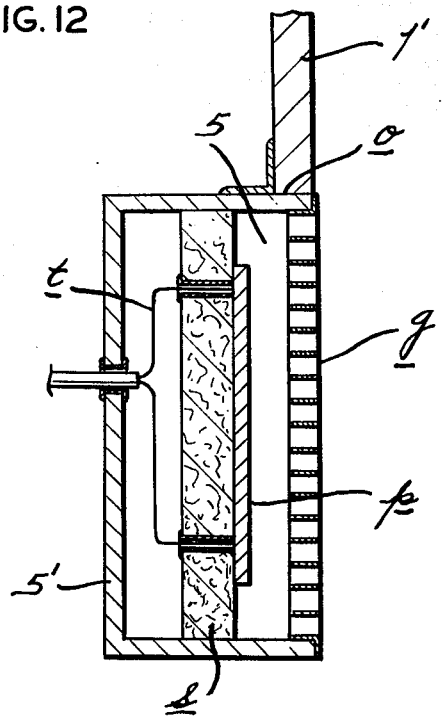
Figure 13:
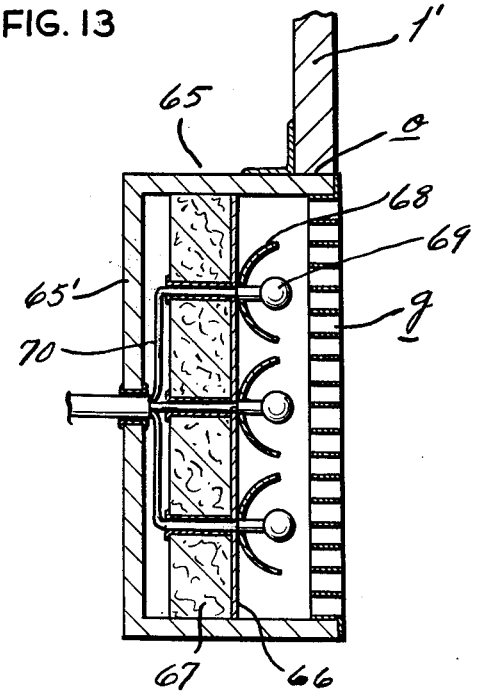

Referring to FIG. 7 it will be seen that when housing h is in downward, operative position, plate 45 will be disposed against the undersurface of top wall 3 and hence beyond interference with the load being treated. It will be noted that in such position, collars 49 will be in abutment against the upper surface of angle supports a,a′ so that the relative location of said collars is determined by consideration of the height of housing h when in lowered position. Upon termination of the shrinking operation, housing h will be elevated in the manner above described and will thus move relatively with respect to plate 45 (see FIG. 9) until top wall 3 engages the undersurface of abutment collars 53 whereupon plate 45 will thence move upwardly with housing h as the same ascends to inoperative position. It is to be especially noted that with housing h in full upward position, with top wall 3 engaging collars 53, plate 45 will be presented across the normally open lower end 4 of housing h. The determination of the location of collars 53 with respect to plate 45 is evident.

As pointed out above, heating elements 5 are constantly maintained at a predetermined controlled temperature, so that when housing h is in inoperative position (FIG. 10) plate 45 effectively closes said housing h so that prevention of heat loss is effected, as well as effecting an even heat distribution throughout the chamber c, thereby obviating an undesired temperature gradient within said housing h so that upon returning said housing to operative position the resultant shrinking will be of desired character. It is to be further observed that by reason of the operations of the heat conservers of this invention, any heat loss from the housing is of such minimal character as to not affect the comfort of the operator.

Plate 45 may be centrally provided with an opening 54 which merely permits of heat relief without causing any appreciable heat loss. Plate 45 promotes marked economy in operation of oven A by substantially inhibiting heat loss while bringing about relatively even distribution of heat within the housing h so that efficacious shrinking is assured.

It will be appreciated that although heat conserver D has been described as vertically movable by means of a counterweight, while conserver D′ has been illustrated as vertically movable through means of slide rods consequent to travel of housing h; it is to be understood that either expedient is readily useful with both modifications.

Having described our invention what we claim and desire to obtain by Letters Patent is:

1. In combination an oven having means defining a housing having side walls, a top wall, and being open at its lower end, means for vertically reciprocally moving said oven housing between upper, inoperative position, and lower, operative position, heat emitting elements providing heat interiorly of said housing, means supporting said heat emitting elements on side walls of said housing spacedly from said top wall, a heat conserver being disposed interiorly of said housing comprising a four-sided frame body being open to the bottom, means rendering said heat conserver vertically shiftable relative to said housing between heat conserver-operative condition wherein the related sides thereof are in aligned relationship with the heat emitting elements provided on the confronting side walls of said housing during inoperative position of said oven housing, and heat conserver-inoperative condition when the same is presented spacedly above, in non-aligned relationship with the respective heat emitting elements when said oven housing is in operative condition whereby heat loss from the interior of the oven housing is substantially inhibited during inoperation of said oven, said heat conserver having outwardly presented surface-forming portions on the sides thereof contoured to direct heat impinging thereon from said heat emitting elements returningly toward said elements.

2. A heat conserver as defined in claim 1 and further characterized by said heat conserver frame body being contoured complementary to the interior of the said oven housing, said heat conserver being of reduced area relative to the cross-sectional area of said oven housing whereby the surface-forming portions of said heat conserver are in adjacency to, but spaced from, the heat emitting elements when in heat conserver-operative condition.

3. A heat conserver as defined in claim 1 and further characterized by said heat conserver frame body having a plurality of horizontally disposed, elongated components mutually secured at their ends to define an open top and an open bottom structure.

4. A heat conserver as defined in claim 3 and further characterized by said heat conserver frame being of contour complementary to the interior of the said oven housing, each frame component having a length substantially as great as that of the heat emitting element on the adjacent side wall of said housing.

5. A heat conserver as defined in claim 4 and further characterized by each of said frame components having a height substantially as great as that of the heat emitting element on the adjacent side wall portion of said housing.

6. A heat conserver as defined in claim 3 and further characterized by each of said components having inner and outer faces, the outer face of each component being in confronting relationship to the heat emitting element of the adjacent side wall of said housing when said housing is in operative position, and with heat reflective surface and non-heat absorbing means provided on the outer face of each frame component.

7. A heat conserver as defined in claim 3 and further characterized by said heat conserver frame being of quadrilateral character.

8. A heat conserver as defined in claim 1 and further characterized by the contour of the portions of said heat conserver directing heat returningly toward said heat emitting elements being of concave character.

9. A heat conserver as defined in claim 8 and further characterized by said heat emitting elements being of the infrared emitter type.

10. A heat conserver as defined in claim 1 and further characterized by the contour of the portions of said heat conserver directing heat returningly toward said heat emitting elements being of outwardly opening, generally V-shape in cross section.

11. A heat conserver as defined in claim 10 and further characterized by said heat emitting elements being of the infrared emitter type.

12. A heat conserver as defined in claim 3 and further characterized by said heat conserver frame being coaxial with the vertical axis of said oven housing.

13. A heat conserver as defined in claim 1 and further characterized by said means for vertically shifting said heat conserver comprising vertically presented slide rods, means engaging the lower ends of said slide rods to said heat conserver, said housing top wall having openings for extension therethrough of said slide rods, and means slideably engaging said slide rods upwardly of said housing when the same is in upper position.

14. A heat conserver as defined in claim 1 and further characterized by said means rendering said heat conserver vertically shiftable comprising vertically presented rods, means engaging said rods at their lower ends to said heat conserver, said housing top wall having openings for slideable extension of said rods therethrough, a counterweight, and flexible means interengaging said rods at their upper ends to said counterweight.

* * * * *